US006131909A

United States Patent [19]

Chilese

[11] Patent Number: 6,131,909

[45] Date of Patent: Oct. 17, 2000

[54] SIMULTANEOUS INTER-RELATED MULTIPLE GROUPING CARD GAME

[76] Inventor: John F. Chilese, 10268 Parkwood Dr., #1, Cupertino, Calif. 95014-6110

[21] Appl. No.: 09/206,667

[22] Filed: Dec. 7, 1998

[51] Int. Cl.[7] ..... A63F 1/00

[52] U.S. Cl. ..... 273/292; 272/293

[58] Field of Search ..... 273/148 A, 150, 273/241, 272, 287, 292, 293, 299; 463/11

[56] References Cited

U.S. PATENT DOCUMENTS

| | | | |
|---|---|---|---|
| 3,606,333 | 9/1971 | Green | 273/241 |
| 4,082,283 | 4/1978 | La Ferla et al. | 273/241 |
| 4,184,685 | 1/1980 | Wilson | 273/241 |
| 5,037,110 | 8/1991 | Haskel | 273/293 |
| 5,524,898 | 6/1996 | Pavlovic | 273/293 |
| 5,547,199 | 8/1996 | Calhoun | 273/299 |
| 5,679,002 | 10/1997 | Scelzo | 273/241 |

OTHER PUBLICATIONS

Reader#s Digest–Book of 1000 Family Games, 1971.

*Primary Examiner*—Benjamin H. Layno

[57] ABSTRACT

A method of simultaneously playing several hands of cards that are arranged to form a two or three-dimensional shape.

1 Claim, 3 Drawing Sheets

SIMULTANEOUS INTER-RELATED MULTIPLE GROUPING CARD GAME

BACKGROUND—FIELD OF THE INVENTION

This invention relates to solitaire gambling card games that are traditionally played in video card game format found in casino electronic machines.

BACKGROUND—DESCRIPTION OF PRIOR ART

Solitaire betting card games have traditionally been played where a player is given a group of cards hereafter referred to as a hand. Said player has options to improve said hand according to a particular set of rules such as those in draw poker and blackjack. The player may sometimes actually worsen the payoff value of the hand in an attempt to obtain a better final hand. The player is given no chance to use the cards to form other hands simultaneously by inter-relating the cards. These games are mundane and provide little enjoyment past the gambling aspect itself. The visual and entertainment value for the player is left wanting.

OBJECTS & ADVANTAGES

Accordingly, several objects and advantages of my invention are:

the simultaneous evaluation of several groups of cards.

an interrelationship between cards used in several groups.

an exterior card which moves to a position to maximize the winning potential of the player's card groups.

DRAWING FIGURES

Figure 1:
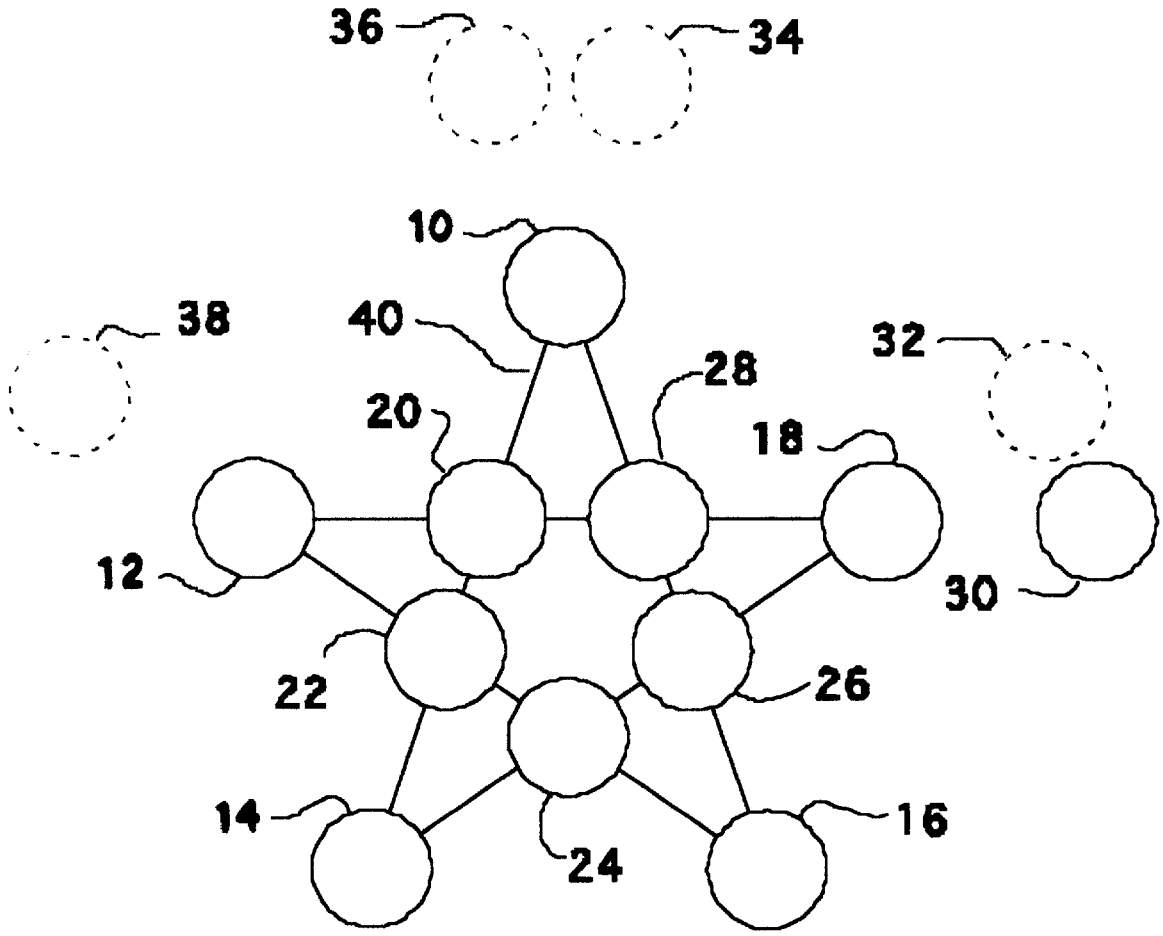
FIG. 1 is a plan view of the basic two-dimensional version of this invention.

| Reference Numerals In Drawings | |
|---|---|
| 10 | Game One Card Position One |
| 12 | Game One Card Position Two |
| 14 | Game One Card Position Three |
| 16 | Game One Card Position Four |
| 18 | Game One Card Position Five |
| 20 | Game One Card Position Six |
| 22 | Game One Card Position Seven |
| 24 | Game One Card Position Eight |
| 26 | Game One Card Position Nine |
| 28 | Game One Card Position Ten |
| 30 | Game One Card Position Eleven |
| 32 | Game One Card Position Twelve |
| 34 | Game One Card Position Thirteen |
| 36 | Game One Card Position Fourteen |
| 38 | Game One Card Position Fifteen |
| 40 | Game One Figure Line |
| 50 | Game Two Card Position One |
| 52 | Game Two Card Position Two |
| 54 | Game Two Card Position Three |
| 56 | Game Two Card Position Four |
| 58 | Game Two Card Position Five |
| 60 | Game Two Card Position Six |
| 62 | Game Two Card Position Seven |
| 64 | Game Two Card Position Eight |

-continued

| Reference Numerals In Drawings | |
|---|---|
| 66 | Game Two Card Position Nine |
| 68 | Game Two Card Position Ten |
| 70 | Game Two Card Position Eleven |
| 72 | Game Two Card Position Twelve |
| 74 | Game Two Card Position Thirteen |
| 76 | Game Two Card Position Fourteen |
| 78 | Game Two Card Position Fifteen |
| 80 | Game Two Card Position Sixteen |
| 82 | Game Two Card Position Seventeen |
| 84 | Game Two Card Position Eighteen |
| 86 | Game Two Card Figure Line |
| 90 | Game Three Card Position One |
| 92 | Game Three Card Position Two |
| 94 | Game Three Card Position Three |
| 96 | Game Three Card Position Four |
| 98 | Game Three Card Position Five |
| 100 | Game Three Card Position Six |
| 102 | Game Three Card Position Seven |
| 104 | Game Three Card Position Eight |
| 106 | Game Three Card Position Nine |
| 108 | Game Three Figure Line |

SUMMARY

In accordance with the present invention a new method of playing a solitaire card game whereby several groups of inter-related cards are simultaneously evaluated for the highest value.

DESCRIPTION—FIGS. 1–3

FIG. 1 is a plan view of the basic embodiment of the two dimensional version of this invention. The shape of this layout is a regular star having five points. At the ten intersections of each typical game one figure line 40 is a circular area that will receive a playing card from a standard deck of playing cards. The outer five intersections of the five pointed star are game one card positions one through five 10, 12, 14, 16, 18. The inner five intersections of the five pointed star are game one card positions six through ten 20, 22, 24, 26, 28. The remaining five game one card positions eleven through fifteen 30, 32, 34, 36, 38 are on a larger diameter and are not attached to the five pointed star. These last five card positions 30, 32, 34, 36, 38 are arranged so that each individual position is on a straight-line arrangement with four of the other game one card positions. For example, game one card position thirteen 34 forms a straight line arrangement with game one card position one 10, game one card position six 20, game one card position seven 22, game one card position three 14.

Figure 2:
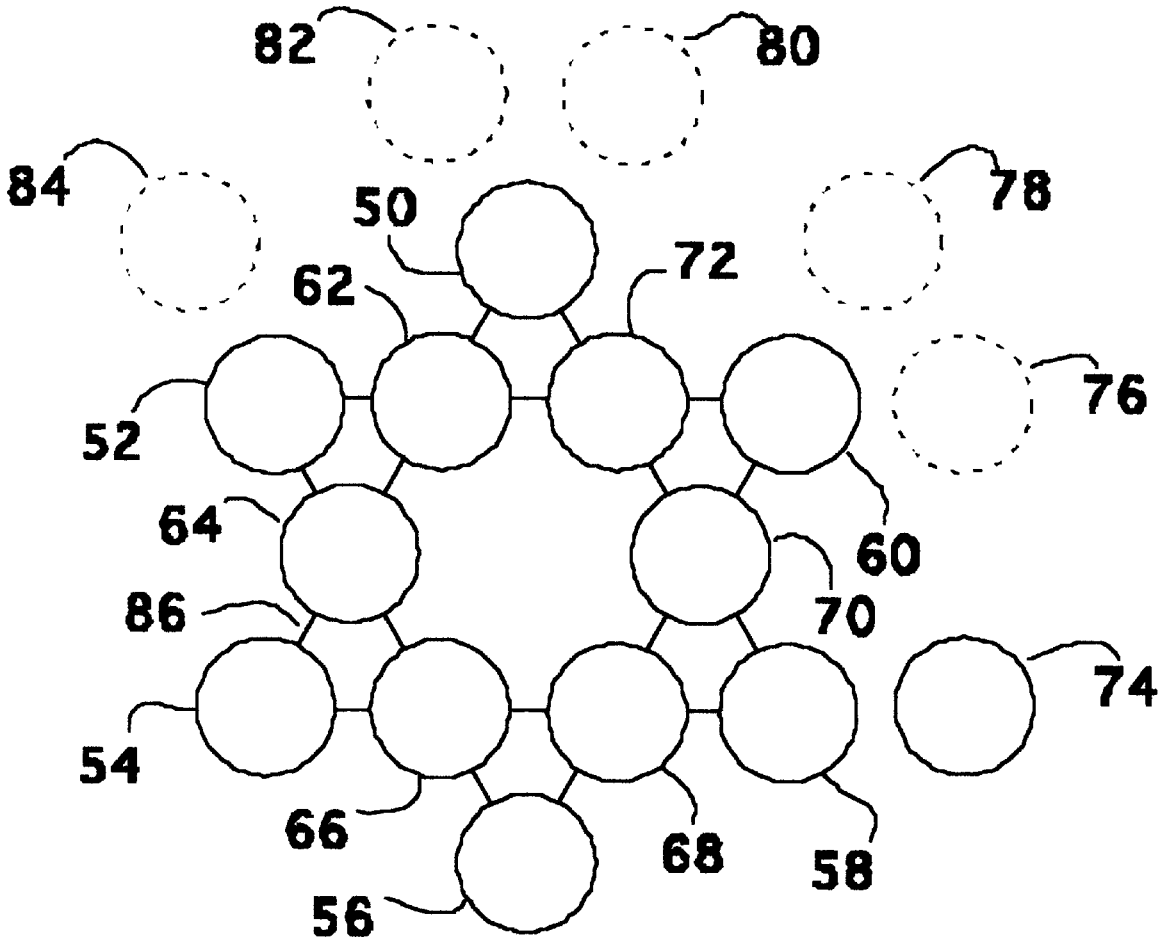
FIG. 2 is a plan view of an extended star formation layout for a larger number of end point configurations. This layout can be extended to star formations with seven or more end points.

FIG. 2 is a plan view of a six pointed star formation layout for the next larger number of end point configurations. This layout concept can be extended to star formations with seven or more end points. The shape of this layout is a regular star having six points. At the twelve intersections of each typical game two figure line 86 is a circular area that will receive a playing card from a standard deck of playing cards. The outer six intersections of the six pointed star are game two card positions one through six 50, 52, 54, 56, 58, 60. The inner six intersections of the six pointed star are game two card positions seven through twelve 62, 64, 66, 68, 70, 72. The remaining six game two card positions thirteen through eighteen 74, 76, 78, 80, 82, 84 are on a larger diameter and are not attached to the six pointed star. These last six card positions 74, 76, 78, 80, 82, 84 are arranged so that each individual position is on a straight-line arrangement with four of the other game one card positions. For example, game two card position eighteen 84 forms a straight line arrangement with game two card position two 52, game two card position eight 64, game two card position nine 66, game two card position four 56.

Figure 3:
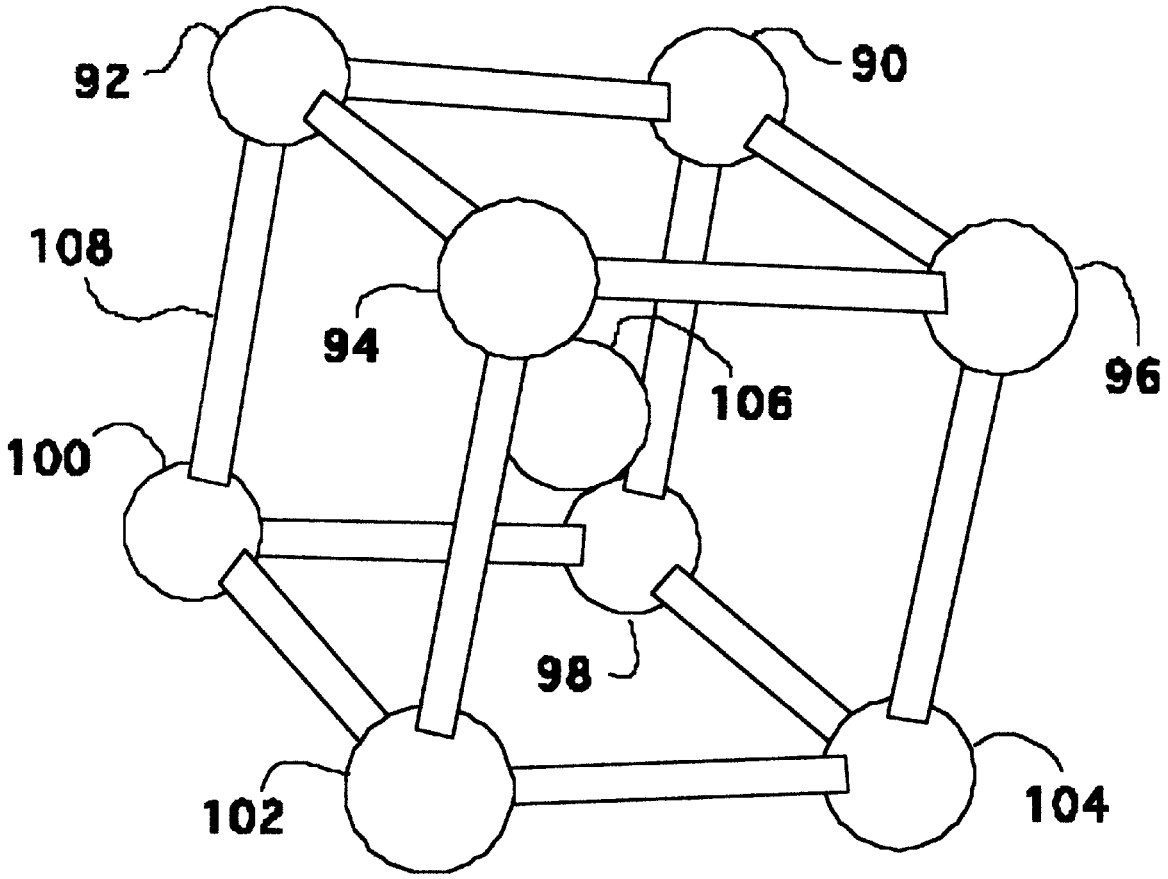
FIG. 3 is a perspective layout of a three dimensional version of this invention.

FIG. 3 is a perspective layout of a three dimensional version of this invention. The shape of this layout is a hollow cube. At the eight corners of each typical game three figure line 108 is a circular area that will receive a playing card from a standard deck of playing cards. At the center of the cube equidistant from each of the eight corners is a ninth circle that will also receive a playing card from the same standard deck of playing cards. The eight corners of the cube are game three card positions one through eight 90, 92, 94, 96, 98, 100, 102, 104. The center circle is game three card position nine 106.

OPERATION—FIGS. 1–3

For this description of operation, an electronic gaming machine is assumed. A dealer may perform the same tasks. This description is of the game itself and does not include any incidentals such as gambling or drawing extra cards.

FIG. 1—Five-Pointed Star Two-Dimensional

Game one card positions one through eleven 10, 12, 14, 16, 18, 20, 22, 24, 26, 28, 30 are each given one random card from a standard deck of playing cards. The card at game one card position eleven 30 will automatically move to one of the other four positions that are outside the star if that forms a higher ranked hand as described below. The final position of the eleventh card will be either game one card position eleven 30, game one card position twelve 32, game one card position thirteen 34, game one card position fourteen 36, or game one card position fifteen 38. The final position of the card is determined by which straight line of five cards makes the best card game hand.

There are seven different five card groups called hands that are evaluated. The first two hands do not use the exterior card. The first hand is composed of the five outer points of the star. The second hand is composed of the inner five intersections forming a pentagon. The remaining five hands all use the exterior card as their fifth card. The exterior card will move to be in line with the line of four cards that form the highest hand using the exterior card. The player's highest-ranking group of cards from those described below is used to determine the player's best hand. In the case of a casino video game, the player would receive a payoff based on this best hand.

The first hand, the outer ring hand, is composed of:

game one card position one 10 game one card position two 12 game one card position three 14 game one card position four 16 game one card position five 18

The second hand, the inner ring hand, is composed of:

game one card position six 20 game one card position seven 22 game one card position eight 24 game one card position nine 26 game one card position ten 28

The third hand is composed of:

game one card position two 12 game one card position six 20 game one card position ten 28 game one card position five 18 game one card position eleven 30

The fourth hand is composed of:

game one card position three 14 game one card position eight 24 game one card position nine 26 game one card position five 18 game one card position twelve 32

The fifth hand is composed of:

game one card position three 14 game one card position seven 22 game one card position six 20 game one card position one 10 game one card position thirteen 34

The sixth hand is composed of:

game one card position four 16 game one card position nine 26 game one card position ten 28 game one card position one 10 game one card position fourteen 36

The seventh hand is composed of:

game one card position four 16 game one card position eight 24 game one card position seven 22 game one card position two 12 game one card position fifteen 38

FIG. 2—Six-Pointed Star Two Dimensional

Game two card positions one through thirteen 50, 52, 54, 56, 58, 60, 62, 64, 66, 68, 70, 72, and 74 are each given one random card from a standard deck of playing cards. The card at game two card position thirteen 74 will automatically move to one of the other five positions that are outside the star if that forms a higher ranked hand as described below. The final position of the thirteenth card will be either game two card position thirteen 74, game two card position fourteen 76, game two card position fifteen 78, game two card position sixteen 80, game two card position seventeen 82 or game two card position eighteen 84. The final position of the card is determined by which straight line of five cards makes the best card game hand.

There are eight different card groups called hands that are evaluated. The first two hands do not use the exterior card. The first hand is composed of the best five cards contained in the six outer points of the star. The second hand is composed of the best five cards contained in the six inner intersections forming a hexagon. The remaining six hands all use the exterior card as their fifth card. The exterior card will move to be in line with the line of four cards that form the highest hand using the exterior card. The player's highest-ranking group of cards from those described below is used to determine the player's best hand. In the case of a casino video game, the player would receive a payoff based on this best hand.

The first hand, the outer ring hand, is composed of the best five cards of:

game two card position one 50 game two card position two 52 game two card position three 54 game two card position four 56 game two card position five 58 game two card position six 60

The second hand, the inner ring hand, is composed of the best five cards of:

game two card position seven 62
game two card position eight 64
game two card position nine 66
game two card position ten 68
game two card position eleven 70
game two card position twelve 72
The third hand is composed of:
game two card position three 54
game two card position nine 66
game two card position ten 68
game two card position five 58
game two card position thirteen 74
The fourth hand is composed of:
game two card position two 52
game two card position seven 62
game two card position twelve 72
game two card position six 60
game two card position fourteen 76
The fifth hand is composed of:
game two card position four 56
game two card position ten 68
game two card position eleven 70
game two card position six 60
game two card position fifteen 78
The sixth hand is composed of:
game two card position three 54
game two card position eight 64
game two card position seven 62
game two card position one 50
game two card position sixteen 80
The seventh hand is composed of:
game two card position five 58
game two card position eleven 70
game two card position twelve 72
game two card position one 50
game two card position seventeen 82
The eighth hand is composed of:
game two card position four 56
game two card position nine 66
game two card position eight 64
game two card position two 52
game two card position eighteen 84

FIG. 3—Hollow Cube Three Dimensional

Game three card positions one through nine 90, 92, 94, 96, 98, 100, 102, 104, 106 are each given one random card from a standard deck of playing cards.

There are six different five card groups call hands that can be formed using this hollow cube formation. The card in the center at game three card position nine 106 is common to all six hands. The player's highest ranking group of cards from those described below is used to determine the player's best hand. In the case of a casino video game, the player would receive a payoff based on his best hand.

The first hand is composed of:
game three card position one 90
game three card position two 92
game three card position three 94
game three card position four 96
game three card position nine 106
The second hand is composed of:
game three card position five 98
game three card position six 100
game three card position seven 102
game three card position eight 104
game three card position nine 106
The third hand is composed of:
game three card position one 90
game three card position two 92
game three card position six 100
game three card position five 98
game three card position nine 106
The fourth hand is composed of:
game three card position four 96
game three card position three 94
game three game position seven 102
game three card position eight 104
game three card position nine 106
The fifth hand is composed of:
game three card position one 90
game three card position four 96
game three card position eight 104
game three card position five 98
game three card position nine 106
The sixth hand is composed of:
game three card position two 92
game three card position three 94
game three card position seven 102
game three card position six 100
game three card position nine 106

Conclusion, Ramifications and Scope

Thus the reader will see that the card game of this invention is a new method for playing solitaire whereby the player will simultaneously play several different hands of inter-related card groups.

While my above description contains many specificities, these should not be construed as limitations on the scope of the invention, but rather as an exemplification of one preferred embodiment thereof. Many other variations are possible. For example the number of points on the star formation for card layouts may be increased beyond the six shown in FIG. 2. The three dimensional version of the invention could be expanded to include shapes other than the cube shown in FIG. 3. The circular areas where the cards are shown could be shaped differently. The straight-line segments joining the different circled areas could be curved. The game could be played in the form of a scratch ticket. The player could be given the option of scrambling the cards already dealt. The player could be given the option of replacing the exterior card.

Accordingly, the scope of the invention should be determined not by the embodiments illustrated, but by the appended claims and their legal equivalents.

What is claimed is:

1. A method of playing a solitaire card game utilizing a standard deck of 52 playing cards to achieve several simultaneous card groups called hands for evaluation, the method comprising:

shuffling the deck of cards;

dealing out a geometric pattern of said cards, such as a five pointed star using ten cards, one to an intersection, with one external moveable card to be used with each straight line group of four cards, such that each card is simultaneously used in multiple groups;

a group defined as a logical straight or curved line pattern of five continuous cards;

evaluating the hands to determine the hand of highest value using the standard evaluation of poker.

* * * * *